US005085049A

United States Patent [19]

Rim et al.

[11] Patent Number: 5,085,049

[45] Date of Patent: Feb. 4, 1992

[54] DIESEL ENGINE EXHAUST FILTRATION SYSTEM AND METHOD

[76] Inventors: Julius J. Rim, 2743 Bloomfield Crossing, Bloomfield Hills, Mich. 48210; Ho Rim, 601-4 Sinsa Dong, Kangnam-Ku, Seoul, Rep. of Korea

[21] Appl. No.: 549,738

[22] Filed: Jul. 9, 1990

[51] Int. Cl.[5] ..... F01N 3/02

[52] U.S. Cl. ..... 60/274; 55/466; 55/DIG. 30; 60/278; 60/279; 60/288; 60/289; 60/295

[58] Field of Search ..... 60/274, 278, 279, 288, 60/289, 295; 55/466, DIG. 30

[56] References Cited

U.S. PATENT DOCUMENTS

| | | | |
|---|---|---|---|
| 4,281,512 | 8/1981 | Mills | 60/311 |
| 4,319,453 | 3/1982 | Mann | 60/311 |
| 4,518,395 | 5/1985 | Petronella . | |
| 4,576,617 | 3/1986 | Renevot . | |
| 4,631,076 | 12/1986 | Kurihara et al. . | |
| 4,685,291 | 8/1987 | Ha . | |
| 4,720,972 | 1/1988 | Rao et al. . | |
| 4,730,454 | 3/1988 | Pischinger et al. . | |
| 4,813,233 | 3/1989 | Vergeer et al. . | |
| 4,864,821 | 9/1989 | Hoch | 60/279 |
| 4,923,484 | 5/1990 | Saito | 55/DIG. 30 |

FOREIGN PATENT DOCUMENTS

| | | | |
|---|---|---|---|
| 214 | 10/1986 | Rep. of Korea . | |
| 244 | 3/1987 | Rep. of Korea . | |
| 2097283 | 11/1982 | United Kingdom | 60/279 |

OTHER PUBLICATIONS

Exhaust-Pollution Control Developments, Research and Development 2 pages, dated before Jun. 1990.

Letter of Oct. 19, 1990, from St. of California, Air Resources Board.

*Primary Examiner*—Douglas Hart

*Attorney, Agent, or Firm*—Peter D. Keefe

[57] ABSTRACT

A diesel engine exhaust filtration system and method which removes both diesel particulate matter (DPM) and unburned hydrocarbons (UHC) from the exhaust gases. Two filters in parallel are used, each alternating operation as the other regenerates. Each filter is preferred to be constructed in a conventional manner and operates at between 100 to 300 degrees Centigrade. A microprocessor controlled valve system regulates which filter is active and which is regenerating and/or inactive. DPM accumulates at the active filter, with UHC condensing on the DPM. When the active filter becomes clogged, the microprocessor switches it to inactive status, and switches the other filter to active status. Low temperature regeneration is initiated by the microprocessor in which DPM and UHC burn slowly across the entire filter. A recirculation conduit provides for the gases produced by the regeneration to be directed to the air intake of the diesel engine. Any remaining UHC or DPM will be subsequently burned in the combustion chambers of the diesel engine or taken out by the other active filter. When regeneration has completed, the inactive filter will await being switched by the microprocessor to active status when the other filter has become sufficiently clogged that it is time for it to be regenerated.

15 Claims, 3 Drawing Sheets

DIESEL ENGINE EXHAUST FILTRATION SYSTEM AND METHOD

BACKGROUND OF THE INVENTION

1. Field of the Invention

The present invention relates to filter traps for Diesel particulate matter, and more particularly to an improved system and method therefor for removing Diesel particular matter (DPM) and unburned hydrocarbons (UHC) from the exhaust of Diesel engines. Still more particularly, the present invention relates to a Diesel exhaust filtration system and method which utilizes dual DPM/UHC traps, low temperature regeneration ignition of the DPM and associated UHC to burn the DPM and UHC into CO and $CO_2$ gases and recirculation of the burned DPM and UHC back into the engine intake for subsequent burning of any remaining UHC in the engine.

2. Description of the Prior Art

Diesel engines provide an efficiency advantage over conventional gasoline engines, and for this reason Diesel engines are a preferred power-plant for many applications. Indeed, Diesel engines are becoming ever more likely to be chosen for automotive use because of their higher efficiency. However, it is a well recognized problems that Diesel engines produce a soot, known as Diesel particulate matter (DPM). DPM is offensive to the average person, especially the person who is first behind a bus or other large engined vehicle. But, actually, DPM is composed mainly of carbon which, though not harmless, is less hazardous than unseen unburned hydrocarbons (UHC) which are known to be carcinogens. Thus, for both the sake of the environment and the health of the public it is very desirable to reduce or eliminate both DPM and UHC from the exhaust of Diesel engines.

In the various devices proposed in the prior art, there is provided a DPM trap consisting in one form or another of a perforated metallic tube covered by a ceramic fiber filter. The metallic tube provides mechanical strength, while the ceramic fiber filter performs the actual DPM removal. As engine operation proceeds, the DPM trap accumulates progressively more DPM. Problematically, the DPM eventually clogs the DPM trap resulting in loss of engine performance and, if left to continue unabated, would cause the engine to stall. Accordingly, there is provided some means for periodically removing the accumulated DPM from the DPM trap. This process of DPM removal is referred to as "regeneration". Regeneration is typically accomplished by burning the DPM at or above its ignition temperature of around 600 degrees Centigrade (in the presence of oxygen), which converts the DPM into CO and $CO_2$. During regeneration, the Diesel exhaust may dump to the atmosphere, or a second DPM trap may be utilized in a cyclic fashion of operation. It will be appreciated in view of the foregoing, that a ceramic fiber filter is preferred as it can withstand the temperatures associated with regeneration, yet can trap DPM which typically are on the order of 0.1 to 0.3 micrometers in size.

Two different approaches have been taken to accomplish periodic regeneration of DPM traps. The first is to operate the DPM Trap as close as possible to the DPM ignition temperature, the second is to operate the DPM trap at lower than the DPM ignition temperature.

The theory behind operating a DPM trap near the ignition temperature of DPM is to permit rapid regeneration with very little additional energy being needed to provide ignition. The operating temperature of the DPM trap is maintained high by locating it near the exhaust manifold, and either fuel or electricity is introduced to initiate ignition of the DPM. In some systems, the Diesel engine RPM is increased so as to provide a suitable hot exhaust gas for ignition of the DPM. Operation of the DPM trap near the DPM ignition temperature, while providing suitable burning of the DPM, results in a very rapid burn process. This frequently leads to DPM trap failure due to thermal shock, shortened life, melt-down, or poor operation under certain driving modes.

The theory behind operating a DPM trap below the ignition temperature of the DPM is to provide regeneration which is less injurious to the DPM trap. In order to achieve ignition of the DPM at a temperature below 600 degrees Centigrade, a DPM oxidation promoting catalyst is introduced into the fuel, added as an exhaust gas chemical agent upstream of the DPM filter, or as a pre-treat for the ceramic fiber filter of the DPM trap. These catalysts are certain metallic compounds, most notably composed of lead, copper, manganese, or noble metals, such as platinum and palladium.

Specific examples of the prior art will now be given.

U.S. Pat. No. 4,576,617 to Renevot, dated Mar. 18, 1986, discloses a Diesel exhaust DPM trap which utilizes a regeneration process in which a very flammable mixture, such as methyl alcohol, is introduced into the DPM trap which, in combination which a glow plug, affects ignition of the DPM. Different mixtures may be used depending on whether the filter of the DPM trap is impregnated with a catalyst, such as either platinum or palladium, as the ignition temperature of the DPM will be different in accordance therewith.

U.S. Pat. No. 4,631,076 to Kurihara et al, dated Dec. 23, 1986, discloses a DPM trap which utilizes regeneration based upon ignition of the DPM caused by selective introduction of catalytic solutions into the exhaust gas upstream of the DPM trap. Examples of suitable metal catalytic compounds include $Pd(NH_4)_3(OH)_2$ and $Cu(NH_3)_4(OH)_2$.

U.S. Pat. No. 4,685,291 to Ha, dated Aug. 11, 1987, and U.S. Pat. No. 4,813,233 to Vergeer et al, dated Mar. 21, 1989, disclose a dual DPM trap system in which periodic regeneration may be achieved at lower than 600 degrees centigrade, where a by-pass conduit allows selectively for heated or cooled exhaust gasses to enter the DPM traps. Four different ways to achieve regeneration are disclosed, as follows. 1) Each of the DPM traps are located remote from the engine, but each is selectively heated by the other's exhaust manifold. When not heated, UHC can accumulate on the pores of the trapped DPM. To effect regeneration, heat from the other DPM trap's exhaust manifold is used to induce ignition of the DPM, where it is believed by the inventor that the UHC serves as a fuel to assist ignition of the DPM at temperatures as low as 250 degrees Centigrade. Exhaust coolers may be used in place of remote placement of the DPM traps. 2) For two-stroke Diesel engines, regeneration is induced by a synergism between the scavenging blower system and introduction of finely atomized fuel above the DPM traps, with a diesel fuel additive being used, such as manganese in concentrations on the order of 100 mg/L of diesel fuel. 3) Regeneration is induced by introduction of finely atomized fuel combined with air above the DPM traps, with a diesel fuel additive being used, such as manganese in concentrations on the order of 80 to 100 mg/L of diesel fuel, or copper. 4) Again, for two-stroke Diesel engines, regeneration is induced by a scavenging blower system which controls the scavenging ratio of the engine, and introduction of finely atomized fuel above the DPM traps, regeneration occurring because of increased exhaust gas temperature at medium load speed conditions, a diesel fuel additive being used, such as manganese in concentration is on the order of 100 mg/L of diesel fuel.

U.S. Pat. No. 4,720,972 to Rao et al, dated Jan. 26, 1988, discloses a dual DPM trap utilizing a heat exchanger to cool the exhaust gases to the range between 200 and 500 degrees Fahrenheit, which produces condensation of UHC upon the DPM at the DPM trap. The DPM trap uses a catalytically coated ceramic fiber or wire mesh, where the catalytic material may comprise $SO_2$ active oxidation catalyst such as platinum, tungsten or paladium-platinum coated on a porous, cellular cordierite body. Electrical heating is used to initiate ignition, and burn front will progressively move down the DPM trap from the ignition location until regeneration concludes in 6 to 9 minutes.

U.S. Pat. No. 4,730,454 to Pischinger et al, dated Mar. 15, 1988, discloses a DPM trap in which regeneration is effected by regulating the DPM concentration which lies within the explosive range of the DPM/exhaust mixture by briefly adding or recycling combustible particulates to the exhaust gas flow at the DPM trap. A secondary source of energy, such as electrical, is used to supply ignition, from which an explosive wave runs progressively through the DPM trap.

While the schemes for cleaning Diesel exhaust are effective to remove DPM, there is presently no successful system which can effectively remove both DPM and UHC from Diesel exhaust.

SUMMARY OF THE INVENTION

The present invention is a Diesel engine exhaust filtration system and method which removes both DPM and UHC from the exhaust gases.

According generally to the apparatus and method of the present invention, two filters are used, each alternating operation as the other regenerates. Each filter is preferred to be constructed in a conventional manner utilizing a perforated tube covered by a ceramic fiber filter media. Each filter is located sufficiently far from the engine, or a heat exchanger is located upstream of the filters, so that the exhaust gases at the filters is approximately between 100 to 300 degrees Centigrade. A microprocessor controlled valve system regulates which filter is active and which is regenerating and/or inactive. DPM accumulates at an active filter, and because of the low ambient temperature, UHC easily condense on the large surface area provided by the DPM and thus also filter out of the exhaust gases. Accordingly, only DPM and UHC free gases pass out the exhaust. When the active filter becomes clogged, the microprocessor switches it to inactive status, and switches the other filter to active status. Regeneration of the inactive filter is initiated by the microprocessor using a glow plug at a predetermined location in the filter, in which DPM and UHC burn slowly across the entire filter. A recirculation conduit provides for the gases produced by the resulting slow regeneration to be directed to the air intake of the Diesel engine. Any remaining UHC or DPM will be subsequently burned in the combustion chambers of the Diesel engine. When regeneration has completed, the inactive filter will await being switched by the microprocessor to active status when the other filter has become sufficiently clogged that it is time for the microprocessor to switch it inactive and thereafter initiate its regeneration.

Accordingly, it is an object of the present invention to provide a Diesel engine exhaust filtration system and method which removes not only DPM but also UHC from the exhaust.

It is a further object of the present invention to provide a Diesel engine exhaust filtration system which provides for continuous filtration even during periodic regeneration episodes.

It is an additional object of the present invention to provide a Diesel engine exhaust filtration system which provides for filtration of exhaust gases at very low temperature, on the order of 100 to 300 degrees Celsius, thereby maximizing removal of UHC on the surface of the accumulated DPM.

It is another object of the present invention to provide a Diesel engine exhaust filtration system which provides for slow regeneration on the order of ten to twenty minutes or longer.

It is yet another object of the present invention to provide a Diesel engine exhaust filtration system which provides for slow regeneration on the order of ten to twenty or longer, in which the gases released during regeneration are directed to the other active filter for filtering out any yet remaining DPM and UHC, thereby providing essentially no DPM or UHC will exit to the atmosphere.

It is still another object of the present invention to provide a Diesel engine exhaust filtration system which provides for slow regeneration on the order of ten to twenty minutes or longer, in which the gases released during regeneration are directed back into the Diesel engine at the air intake, thereby providing final burning of all released UHC vapor and any remaining DPM.

It is yet an additional object of the present invention to provide a Diesel engine exhaust filtration system which provides for slow regeneration on the order of ten to twenty minutes or longer, in which atmospheric air is introduced into the filter undergoing regeneration so as to facilitate the oxidation process.

It is yet a further object of the present invention to provide a dual filter Diesel engine exhaust filtration system equipped with a microprocessor controlled valve system which regulated automatically which filter is active, which filter is inactive and/or regenerating, introduction of atmosphere air into the regenerating filter and selective routing of exhaust into and out of the filters, inclusive of routing of gases released during regeneration back to the Diesel engine air intake.

It is still an additional object of the present invention to provide a Diesel engine exhaust filtration system which uses a metallic compound of copper based fuel catalyst for promoting regeneration at relatively low temperature, a stabilizer being added to the fuel comprising ethyl or methyl alcohol in the amount of 3 to 10 percent by volume.

These, and additional objects, advantages, features and benefits of the present invention will become apparent from the following specification.

DETAILED DESCRIPTION OF THE PREFERRED EMBODIMENT

Figure 1:
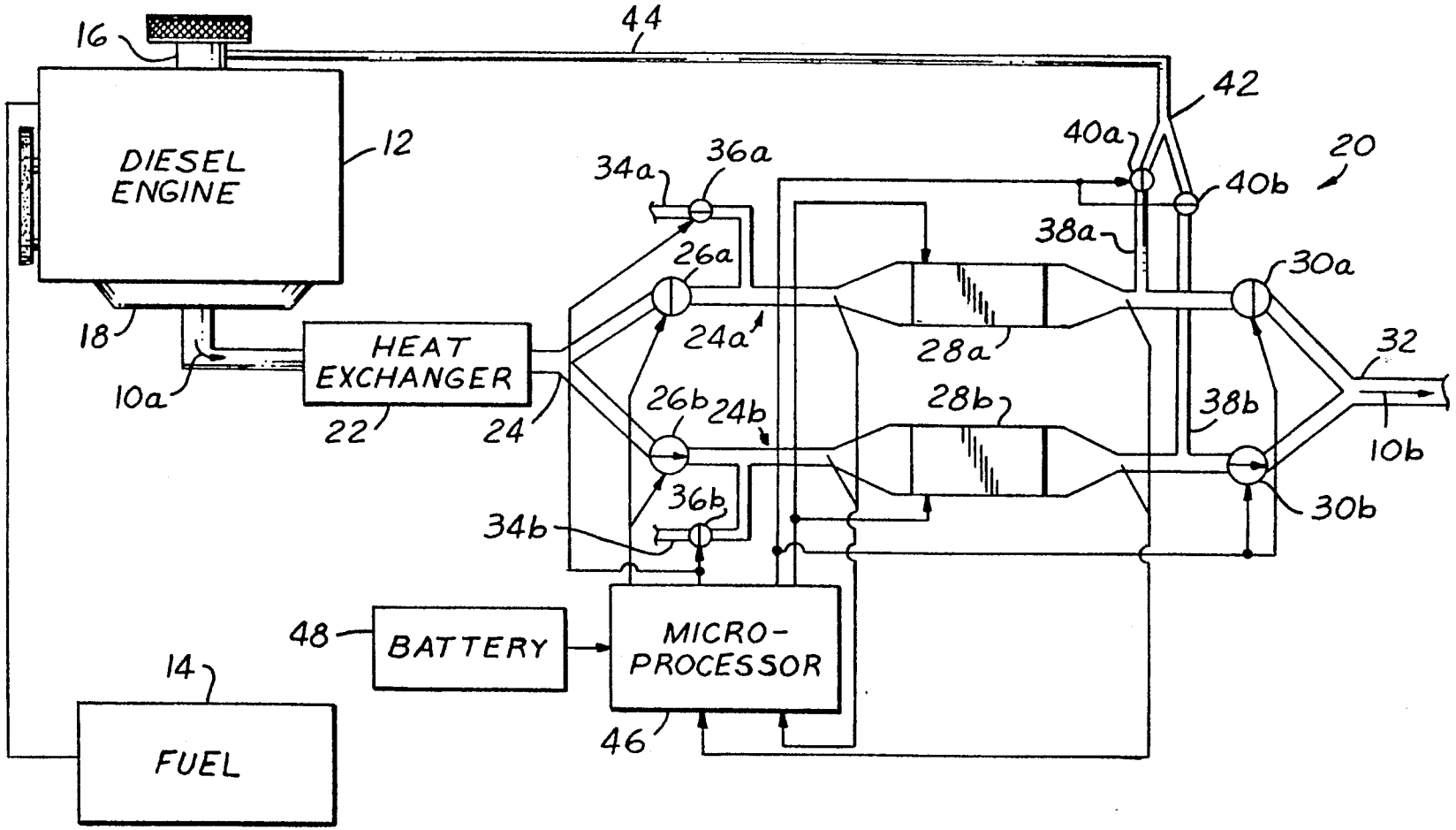
FIG. 1 is a schematic depiction of the Diesel exhaust filtration system according to the present invention.

Referring now to the Drawing, FIG. 1 shows generally the Diesel exhaust filtration system according to the apparatus and method of the present invention. Briefly stated in terms of an overview, the Diesel exhaust filtration system according to the present invention operates on the basis of selecting one filter for filtering while a second filter connected in parallel with the first filter is being regenerated. During regeneration, air from the atmosphere is admitted to ensure optimum oxidation, while the by-products of regeneration are directed back to the Diesel engine at the air intake for final and complete burning in the combustion chambers of any remaining DPM or UHC, and subsequent refiltering through the other active filter. Thus, at all times only filtered exhaust reaches the atmosphere.

The apparatus for carrying-out the preferred embodiment of the present invention as follows.

The Diesel engine 12 operates conventionally, utilizing fuel 14, which may or may not be treated with a catalyst, and utilizing air through its air intake 16. The combustion by-products in the form of various unfiltered exhaust gases 10*a*, including diesel particulate matter (DPM) and unburned hydrocarbons (UHC) 10, exit the Diesel engine at an exhaust manifold 18 and enter an exhaust filtration system 20, the exhaust filtration system has the following components.

A heat exchanger 22 is located downstream of the exhaust manifold 18 and is used for cooling the Diesel exhaust as it firstly enters the exhaust filtration system 20. Downstream of the heat exchanger 22 is a first Y-shaped branching pipe 24 which defines a first and second branch 24*a* and 24*b*, respectively. Downstream of the first Y-shaped branching pipe 24 is a first shut-off valve 26*a* and 26*b* respectively at each branch 24*a* and 24*b* for selectively shutting off exhaust gas flow along that respective branch. Downstream of each respective first shut-off valve is located a filter 28*a* and 28*b* interconnected with each branch 24*a* and 24*b*, respectively. Downstream of each filter 28*a* and 28*b* is located a second shut-off valve 30*a* and 30*b* interconnected with each branch 24*a* and 24*b*, respectively. Downstream of each second shut-off valve 30*a* and 30*b* is located a second Y-shaped branching pipe 32 interconnected with each branch 24*a* and 24*b*, from which filtered exhaust gases 10*b* exit to the atmosphere. Further, located between the first valves 26*a* and 26*b* and the filters 28*a* and 28*b* of each respective branch 24*a* and 24*b*, are air inlets 34*a* and 34*b* respective for each branch 24*a* and 24*b*; each air inlet being controlled by respective inlet valves 36*a* and 36*b* for admitting air during regeneration of a respective filter. Still further, located between the filter 28*a* and 28*b* and the second shut-off valves 30*a* and 30*b* of each respective branch 24*a* and 24*b*, are exhaust recirculation conduits 38*a* and 38*b* for each branch 24*a* and 24*b*; each exhaust recirculation conduit being controlled by respective conduit valves 40*a* and 40*b* of each respective branch 24*a* and 24*b*. An exhaust recirculation conduit 44 connects at one end to the Diesel engine air intake 16, and at the other end to a Y-shaped conduit 42 which in turn connects with the conduit valves 40*a* and 40*b*. Operation of the above enumerated valves and filters is controlled by a microprocessor 46 which is powered by a source of electrical energy 48, and which electrically senses the condition of the filters 28*a* and 28*b* and electrically operates the valves and the filtering and regeneration operations of the filters.

The heat exchanger 22 provides for reduction in Diesel exhaust gas 10*a* temperatures so that at the filters 28*a* and 28*b*, the temperature is in the area of between 100 and 300 degrees Centigrade. This temperature range is preferred so that UHC will condense upon the surface of trapped DPM at the active or filtering filter, which is filter 28*b* in FIG. 1 (while filter 28*a* is the inactive or regenerating filter). Alternatively, the heat exchanger may be obviated by placing the filters 28*a* and 28*b* remote from the exhaust manifold 18.

It will be seen from FIG. 1, that the following processes are occurring. Hot Diesel exhaust gas 10*a* is cooled by passage through the heat exchanger 22. First shut-off valve 26*a* is closed, thereby closing off branch 24*a*, while first shut-off valve 26*b* is open, thereby permitting unfiltered exhaust gas 10*a* to pass to the active filter 28*b*. The unfiltered exhaust gas is thereupon filtered at the active filter 28*b*, during which removal of DPM and UHC takes place. Filtered exhaust gas 10*b* then leaves the active filter 28*b*, passes through open second shut-off valve 30*b* and passes finally out to the atmosphere. Meanwhile, inactive filter 28*a* is being regenerated. Ignition of the trapped DPM and UHC in the inactive filter28*a* is commenced by a glow plug igniter (not shown in FIG. 1) via operation of the microprocessor 46. The microprocessor 46 also regulates the opening of intake valve 36*a* so as to ensure complete oxidation in the inactive filter 28*a*. As oxidation proceeds over an extended time period on the order of 10 to 20 minutes, the released gases are directed through open conduit valve 40*a* back to the air intake 16 of the Diesel engine, where cylinder combustion will burn any remaining uncombusted DPM and UHC. Should, however, any DPM and UHC yet remain, these will be trapped at the active filter 28*b*, so that in no event will DPM and; or UHC reach the atmosphere.

Figure 2:
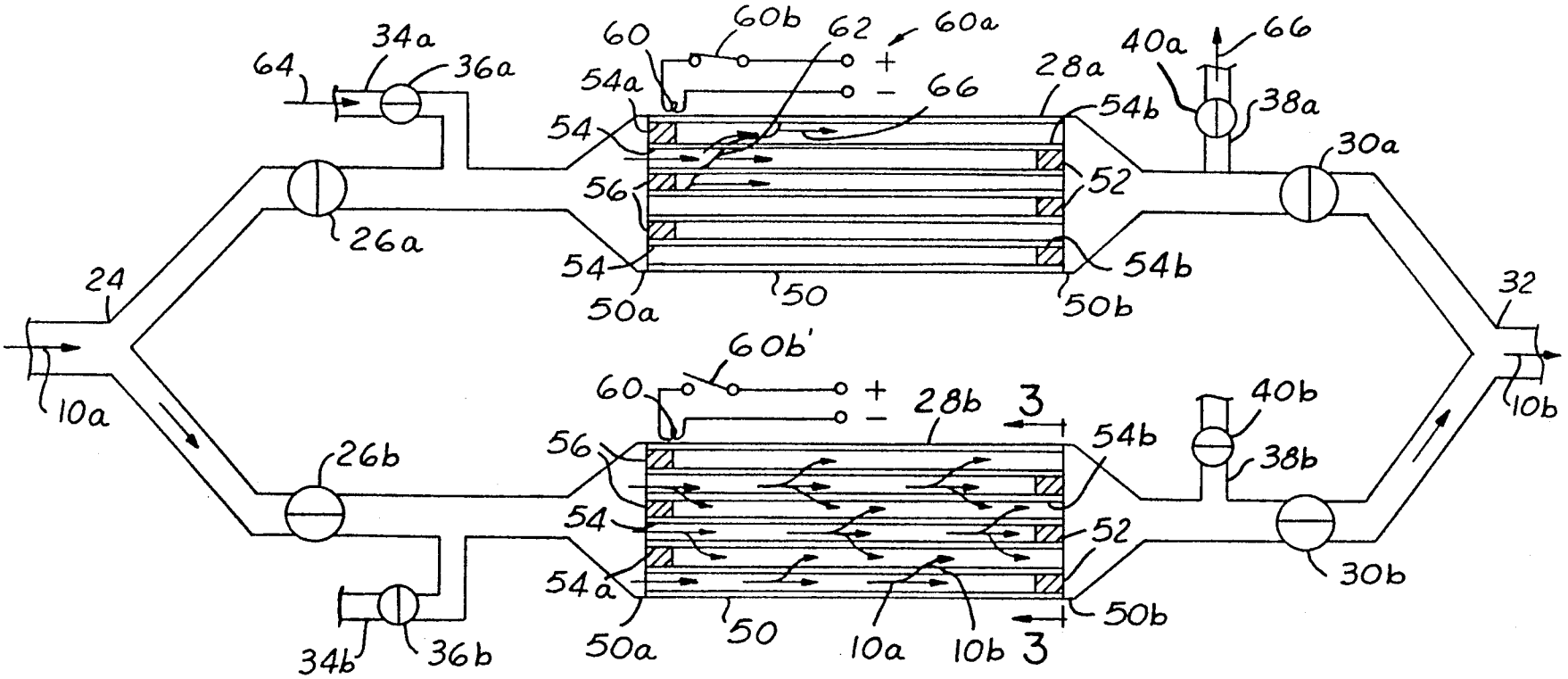
FIG. 2 is a part sectional plan view of the Diesel exhaust filtration system according to the present invention, showing in detail the exhaust path through the filters.
Figure 3:
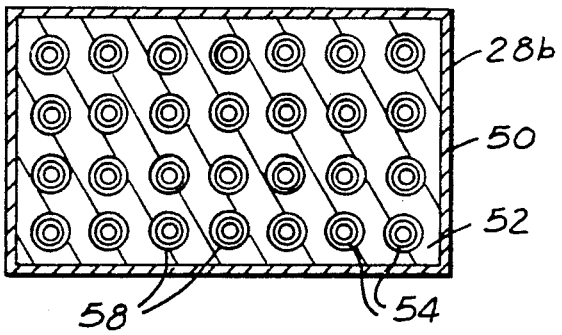
FIG. 3 is a sectional front view of one of the filters shown in FIG. 2, showing a plurality of internal filter components.
Figure 4:
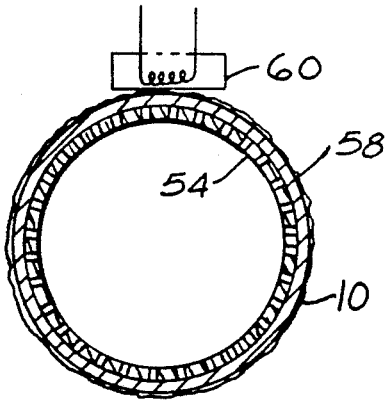
FIG. 4 is a detail part sectional front view of a filter component shown in FIG. 3, as well as an electronic regeneration igniter according to the present invention.

With reference now being made to FIGS. 2 through 4, a more detailed description of the filtration and regeneration apparatus and processes will be recounted, where FIG. 2 shows the exhaust filtration system 20 in the mode depicted in FIG. 1.

FIGS. 1 and 2 depict the exhaust filtration system 20 at a time when filter 28*a* has been rendered inactive because of an earlier active duty period in which it became clogged with DPM and UHC. Thus, the microprocessor 46 sensed the back pressure caused by this clogging and has caused first shut-off valve 26*b* to be opened, then caused fir shut-off valve 26*a* to be closed. The microprocessor 46 has also closed intake valve 36*b*, opened intake value 36*a*, closed conduit valve 40*b*, opened conduit valve 40*a*, opened second shut-off valve 30*b* and closed second shut-off valve 30*a*. FIG. 2 depicts the exhaust filtration system 20 where filter 28*a* is now inactive with regeneration just underway, and where filter 28*b* is active and is presently filtering unfiltered exhaust gases 10*a*. It will be understood, therefore, that unfiltered exhaust gas 10*a* are filtered at active filter 28*b*, then the filtered exhaust gas 10*b* must pass the second shut-off valve 30*b*, then must exit to the atmosphere. It will be further understood that regeneration at inactive filter 28*a* is facilitated by air entry at air intake 34*a*, and gases released by the regeneration oxidation process are vented through the conduits 38*a*, 42 and 44 and conduit valve 40*a* back to the air intake 16 of the Diesel engine 12.

Filtration at filter 28*b* of the unfiltered exhaust gas 10*a* and regeneration of filter 28*a* will now be more particularly detailed.

Both filters 28*a* and 28*b* are identical and constructed in a generally conventional manner as depicted with greater particularity in FIGS. 2 through. The filters 28*a* and 28*b* are preferably constructed as follows. An airtight casing 50 is provided which is closed at its downstream end 50*b* by a wall 52. A plurality of perforated pipes 54 are connected with the wall 52 at the downstream end 54*b* thereof, and communicate with respective second shut-off valves 30*a*, 30*b*. The upstream end 54*a* of the perforated pipes 54 are plugged by plugs 56 located adjacent the upstream end of the airtight casing 50. The perforated piping is covered by a ceramic fiber filter media 58 which is chosen to both withstand operational temperatures of the filter during filtration and regeneration, as well as filter out DPM of a pre-selected cross-sectional size. A glow plug 60 is provided adjacent the ceramic fiber filter media for commencing ignition of the accumulated DPM and UHC when regeneration is desired. It is to be understood that the Drawing figures are merely schematic, and that an operational filter 28*a*, 28*b* would be optimized in terms of its structure and geometry so as to provide most efficacious filtration and regeneration.

Considering now the filtration operation at active filter 28*b*, the exhaust gas 10*a* will pass through the ceramic fiber filter media 58 between the upstream and downstream ends of the casing, into the perforated pipes 54 and then through second shut-off valve 30*b* as filtered exhaust gas 10*b*. As indicated above, the operational temperature of the filter 28*b* is in the range of 100 to 300 degrees Centigrade because this is the temperature of the exhaust gas 10*a* at the filter 28*b* due to operation of the heat exchanger 22. In the range of temperature, as DPM accumulate on the ceramic fiber filter media 58, and UHC tend to condense onto the surface of the DPM. Thereby coating the DPM rather than exiting the filter, as would occur if the operational temperature of the filter were higher. Accordingly, little or no UHC will exit out the exhaust filtration system 20 to the atmosphere.

Considering now the regeneration operation at inactive filter 28*a*, the glow plug 60 is activated by a source of electricity 60*a* and the closing of a switch 60*b* via a signal sent from the microprocessor 46. The accumulated DPM and UHC which are situate on the ceramic fiber filter media 58 will be caused to ignite by the heat of the glow plug. It is desired that regeneration proceed in the desired operational temperature range of 100 to 300 degrees Centrigrade, and in order to accomplish this, a catalyst must be introduced to lower the combustion temperature of the DPM. The conventional catalyst which may be used is of a class of metallic compounds, containing usually lead, copper or manganese. The catalyst may be introduced into the fuel, may be introduced into the unfiltered exhaust gas 10*a* upstream of the filters 28*a*, 28*b* (preferably only the inactive filter during its regeneration), or may be impregnated into the ceramic filter fiber media itself. Once ignition is initiated by the glow plug, a combustion front 62 will fan outwardly across the ceramic fiber filter media over a slow burn period on the order of 10 to 20 minutes. The combustion of the DPM and UHC requires oxygen to proceed. This is provided by the microprocessor 46 opening intake valve 36*a* sufficiently to ensure an adequate amount of air 64 within the inactive filter 28*a*; an external blower (not shown) may provide additional air flow into the filter. With second shut-off valve 30*a* closed, the by-products of the regeneration burn are directed out through the conduit valve 40*a*, along conduit components 38*a*, 42 and 44 to the air intake 16 of the Diesel engine 12. By recirculating the regeneration burn by-products 66 back into the Diesel engine, any unburned DPM or remaining UHC will be consumed in its combustion chambers. Of course, any yet remaining unburned DPM or UHC will be retained at the active filter 28*b*, and will thereafter be later subjected to a regeneration burn and combustion chamber burn when filter 28*b* goes through its regeneration.

Figure 5A:
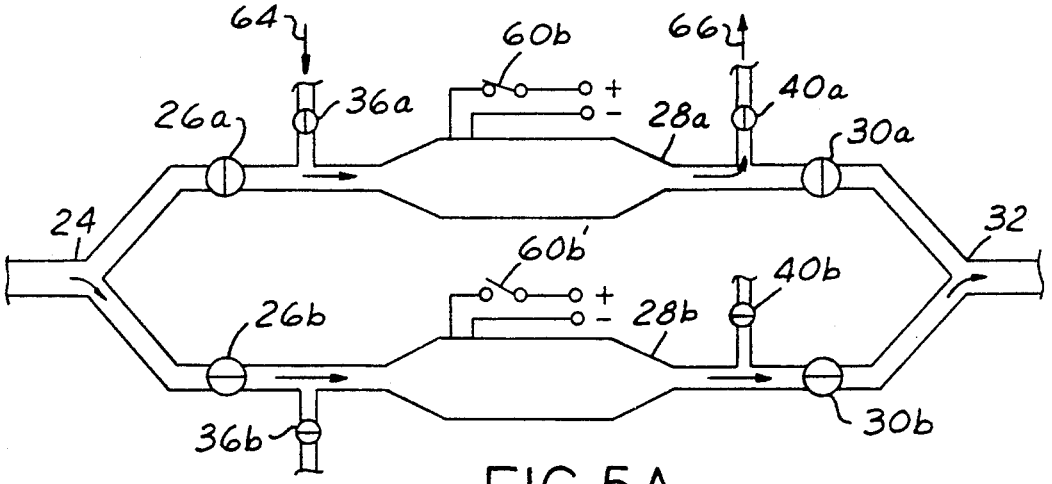
FIGS. 5A and 5B depict part sectional side views of the Diesel exhaust filter system according to the present invention as generally depicted in FIG. 2, alternatively showing gas routing for each filter depending on respective active and inactive status.
Figure 5B:
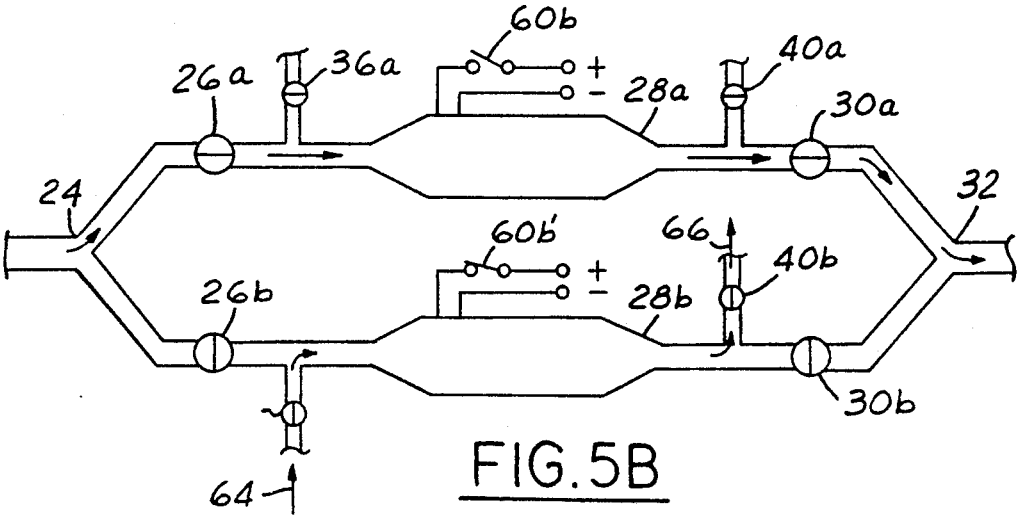

Turning now to FIGS. 5A and 5B, the method of providing a continuous Diesel exhaust filtration process where no DPM or UHC are emitted to the atmosphere will be explained, where FIG. 5A depicts the situation as described above relative to FIGS. 1 and 2. Processes at FIGS. 5A and 5B will be considered consecutively.

Regarding inactive filter 28*a*, the microprocessor 46 has closed both first and second shut-off valves 26*a* and 30*a* in order to isolate the inactive filter from the exhaust gases 10*a* and 10*b*. Further, the microprocessor opens intake valve 36*a* and conduit valve 40*a*. Thereupon, regeneration is initiated by the microprocessor closing switch 60*b* thereby heating glow plug 60 ( not shown in FIG. 5A) Regeneration commences as the DPM and UHC ignite adjacent the glow plug, and slowly a combustion front fans out to spread across the entire ceramic fiber filter media of the inactive filter. The microprocessor senses the presence of the progressive oxidation burn and opens switch 60*b*, thereby turning off the glow plug, which is no longer needed. The regeneration oxidation process is assisted by air entry via the intake valve 36*a* and the by-products of regeneration are directed via the conduits associated with conduit valve 40*a* back to the Diesel engine at the air intake 16. Because regeneration occurs at a low temperature of preferably between 100 and 300 degrees Celcius due to the presence of the catalyst, the burn rate is slow. Accordingly, the by-products of the regeneration burn may be recycled back into the Diesel engine intake with adversely affecting engine performance. By recirculating the regeneration by-products into the air intake 16, any remaining unburned DPM and remaining UHC will be combusted in the Diesel engine, and, if any yet remain thereafter, these will be subsequently trapped in the active filter 28*b* so that virtually no DPM or UHC will exit to the atmosphere. When the microprocessor senses that regeneration has completed, it closes the intake valve 36*a* and conduit valve 40*a*.

Regarding active filter 28*b*, the microprocessor 46 has opened first and second shut-off valves 26*b* and 30*b*, while intake valve 36*b* and conduit valve 40*b* remain closed. Unfiltered exhaust gas 10*a* passes through the active filter by being forced through the ceramic fiber filter media where the DPM and UHC accumulate. Filtered exhaust gas 10*b* now passes through the perforated pipe and out the exhaust filtration system 20 to the atmosphere. In time the ceramic fiber filter media will become progressively more clogged with DPM and UHC. Eventually, back pressure will build to the point that engine performance will be endangered. The microprocessor 46 senses this back pressure upstream of active filter 28*b*.

When a pre-set value of back pressure is reached, the microprocessor takes the active filter 28*b* out of duty and places the inactive filter 28*a* into duty. The microprocessor opens first and second shut-off valves 26*a* and 30*a*, while intake valve 36*a* and conduit valve 40*a* remain closed. Now filter 28*a* is the active filter, as depicted in FIG. 5B. Thereafter, the microprocessor closes first and second shut-off valves 26*b* and 30*b*, opens intake valve 36*b* and opens conduit valve 40*b*. Now, filter 28*b* is the inactive filter, as depicted in FIG. 5B. Thereupon the microprocessor closes switch 60*b*', thereby effecting the glow plug of filter 28*b* to heat and initiate a regeneration combustion front of the DPM and UHC in the ceramic fiber filter media of filter 28*b*. Once the microprocessor senses the self-sustained combustion front it opens the switch 60*b*' to thereby turn off the glow plug. Regeneration is assisted by air which is introduced via intake valve 36*b* and the by-products of the regeneration process are directed via conduit valve 40*b* and its associated conduits to the air intake 16 of the Diesel engine 12 in the manner aforesaid. When the microprocessor senses that regeneration of filter 28*b* is completed, it will cause intake valve 36*b* and conduit valve 40*b* to close.

The microprocessor will sense back pressure upstream of filter 28*a*, and when the pre-set value of back pressure is reached the operations of the filters will reverse back to that depicted in FIG. 5A, in the manner hereinabove generally described. Thus and thereby, continual filtration is accomplished, with periodic regeneration effected, and virtually no DPM or UHC ever entering into the atmosphere. Further, by the use of recirculation back to the air intake during regeneration, nitrous oxide emissions will be notably reduced, as the compounds responsible therefor that have been trapped at the ceramic fiber filter media will have been exposed to combustion during regeneration and again in the combustion chambers of the Diesel engine.

Further according to the present invention, when a catalyst containing metallic compounds of copper is added to the fuel, there is a tendency for the fuel to degrade undesirably. In order to provide a copper based catalyst for the low temperature regeneration process, yet ensure stability of the fuel, it has been found that the addition of ethyl alcohol or methyl alcohol in the concentration of 3 to 10 percent by volume of fuel will stabilize the fuel and prevent its degradation.

To those skilled in the art to which this invention appertains, the above described preferred embodiment may be subject to change or modification. For instance, both filters could be actively filtering simultaneously during at least some portion of the normal duty time of one of them. Also, rather than routing by conduit the by-products of regeneration of the inactive filter to the air intake of the Diesel engine, the by-products could be introduced by conduit into the unfiltered exhaust gas 10*a* upstream of the active filter. Such change or modification can be carried out without departing from the scope of the invention, which is intended to be limited only by the scope of the appended claims.

What is claimed is:

1. A filtration system for removing Diesel particulate matter and unburned hydrocarbons from exhaust gas of a motor vehicle powered by a Diesel engine, said filtration system being connected with an exhaust system of the motor vehicle, the Diesel engine having an air intake for aspiration, said filtration system comprising:

a first filter connected with the exhaust system, said first filter being structured so as to trap Diesel particulate matter from the exhaust gas;

a second filter connected with the exhaust system, said second filter being structured so as to trap Diesel particulate matter from the exhaust gas;

first valve means connected with the exhaust system for selecting at least one of said first and second filters for filtering said exhaust gas;

exhaust gas cooling means connected with said exhaust system upstream of said first and second filter means for providing a predetermined exhaust gas temperature at said first and second filters whereat said unburned hydrocarbons will condense out of said exhaust gas, said condensed unburned hydrocarbons at least in part condensing onto said trapped Diesel particulate matter;

ignition means connected with said first and second filters for selectively initiating regeneration of said first and second filters;

catalytic low temperature regeneration means present at each of said first and second filters during the respective regeneration thereof, said catalytic low temperature regeneration means providing for combustion of said Diesel particulate matter and said unburned hydrocarbons at a predetermined rate;

second valve means connected with said first and second filter means for selectively admitting air into one of said first and second filters when said one of said first and second filters is being regenerated;

conduit means for routing combustion gases produced by said combustion in any of said first and second filters to the air intake of the Diesel engine, said predetermined rate of combustion producing said combustion gases at a rate which does not adversely affect performance of the Diesel engine; and third valve means connected with said conduit means for selectively routing said gases produced by combustion in any of said first and second filters to the air intake of the Diesel engine.

2. The filtration system of claim 1, further comprising microprocessor means for controlling each of said first, second and third valve means, and for controlling said ignition means so as to optimize filtering performance of said first and second filters.

3. The filtration system of claim 2, wherein said predetermined exhaust gas temperature at said first and second filters is substantially between 100 and 300 degrees Centigrade.

4. The filtration system of claim 3, wherein said catalytic low temperature regeneration means provides a combustion temperature of substantially between 100 and 300 degrees Centigrade, thereby providing said predetermined combustion rate.

5. The filtration system of claim 4, wherein said exhaust gas cooling means is a heat exchanger.

6. A method for filtering Diesel particulate matter and unburned hydrocarbons from exhaust gas of a motor vehicle powered by a Diesel engine, the Diesel engine having an air intake for aspiration, the motor vehicle having an exhaust system connected to the Diesel engine, the method comprising the steps of:

a) filtering at a first location the exhaust gas by trapping Diesel particulate matter and by accumulating unburned hydrocarbons until a predetermined amount of Diesel particulate matter has been trapped;

b) after a first predetermined event has occurred, filtering at a second location the exhaust gas by trapping said Diesel particulate matter and accumulating said unburned hydrocarbons until said predetermined amount of Diesel particulate matter has been trapped at said second location;

c) combusting said trapped Diesel particulate matter and said accumulated unburned hydrocarbons at said first location;

d) filtering at said second location the combusted Diesel particulate matter and the combusted accumulated hydrocarbons of said first location;

e) after a second predetermined event has occurred, filtering at said first location the exhaust gas by trapping said Diesel particulate matter and accumulating said unburned hydrocarbons until said predetermined amount of Diesel particulate matter has been trapped at said second location;

f) combusting said trapped Diesel particulate matter and said accumulated unburned hydrocarbons at said second location;

g) filtering at said first location the combusted Diesel particulate matter and the combusted accumulated hydrocarbons of said second location; and h) repeating the aforesaid steps as needed so as to continuously filter the exhaust gas.

7. The method of claim 6, further comprising the step of pre-cooling the exhaust gas before each said step of filtering to a temperature at said first and second locations in which said unburned hydrocarbons will condense onto said trapped Diesel particulate matter.

8. The method of claim 7, wherein said step of pre-cooling reduces the exhaust gas temperature to substantially between 100 to 300 degrees Centigrade at said first and second locations.

9. The method of claim 7, wherein said steps d) and g) further comprise directing said combusted Diesel particulate matter and said unburned hydrocarbons to the air intake of the Diesel engine.

10. The method of claim 9, wherein said steps d) and g) comprise said combustion occurring at a predetermined rate so that said combusted Diesel particulate matter and said unburned hydrocarbons can be introduced into said air intake without adversely affecting performance of the Diesel engine.

11. The method of claim 10, wherein said steps c) and f) further comprise selective ignition of combustion of said Diesel particulate matter and said unburned hydrocarbons.

12. The method of claim 10, wherein said steps d) and g) further comprise selectively introducing air into said first and second locations respectively in order to facilitate said steps of combusting.

13. The method of claim 12, further comprising the step of providing a catalyst at said first and second locations during respective said steps of combusting so that said predetermined rate of combustion occurs.

14. The method of claim 13, wherein said first predetermined event is the attainment of a predetermined amount of Diesel particulate matter trapped at said second location; further wherein said second predetermined event is the attainment of a predetermined amount of Diesel particulate matter trapped at said first location.

15. The method of claim 13, wherein said first predetermined event is the completion of said steps f) and g); further wherein said second predetermined event is the completion of said steps c) and d).

* * * * *